United States Patent [19]

Hendrickson

[11] Patent Number: 4,682,960

[45] Date of Patent: Jul. 28, 1987

[54] TROLLING MOTOR MOUNT

[76] Inventor: Gregory L. Hendrickson, 607 N. Second St., Mankato, Minn. 56001

[21] Appl. No.: 775,502

[22] Filed: Sep. 12, 1985

[51] Int. Cl.[4] ..... B63H 5/12

[52] U.S. Cl. ..... 440/53; 114/364; 248/640

[58] Field of Search ..... 440/112, 900, 53; 114/343, 364; 248/640–643

[56] References Cited

U.S. PATENT DOCUMENTS

| | | | |
|---|---|---|---|
| 2,592,772 | 4/1952 | Wardius | 248/642 |
| 3,025,028 | 3/1962 | Corbin, Jr. et al. | 248/643 |

*Primary Examiner*—Jeffrey V. Nase

*Assistant Examiner*—Jesûs D. Sotelo

*Attorney, Agent, or Firm*—Merchant, Gould, Smith, Edell, Welter & Schmidt

[57] ABSTRACT

An improved trolling motor mount is the subject of this invention. The motor mount comprises a slotted plate (4), threaded cylinders (13) and shafts (9). The trolling motor (3) is mounted on the slotted plate (4), which is fastened by shafts (9) to the threaded cylinders (13). Threaded cylinders (13) are mounted within the hull material of the boat (1). In preferred form, the shaft (9) is biased by a spring (14) within the threaded cylinder (13) such that the heads (10) of the shafts (9) hold the plate (4) against the side of the boat (1). In another embodiment, the shaft (9) is threaded and is held within the threaded cylinder (13) by a nut (21).

3 Claims, 5 Drawing Figures

FIG. 1
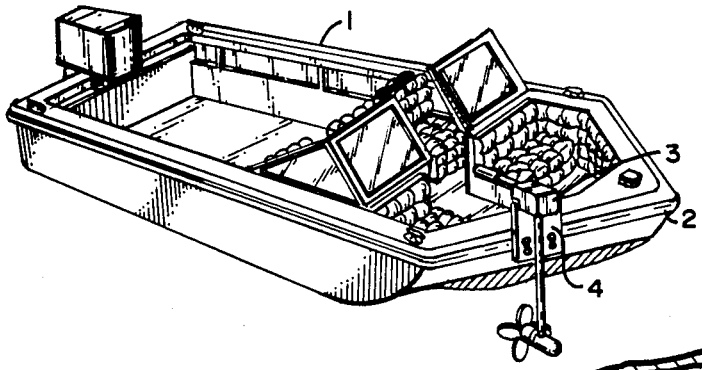
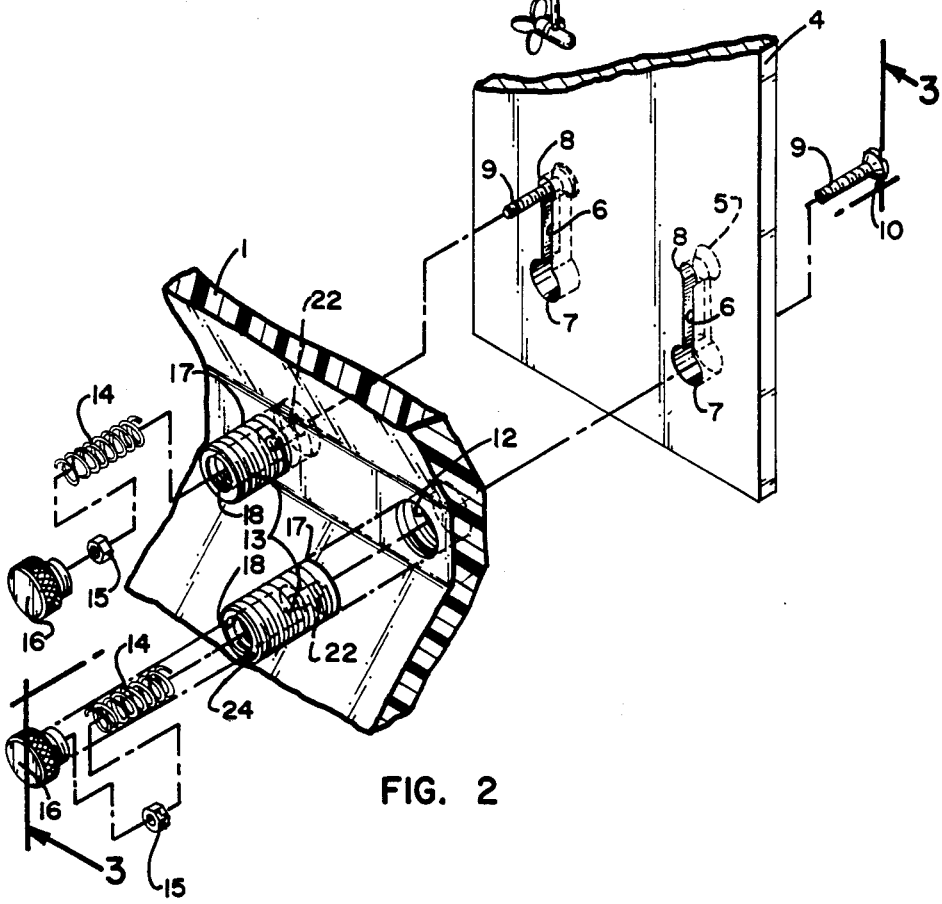
FIG. 2

TROLLING MOTOR MOUNT

BACKGROUND OF THE INVENTION

1. Field of the Invention

This invention relates generally to the field of quick release fastening systems. More specifically, the invention is directed to a spring loaded shaft countersunk within a cylindrical housing in a manner permitting the shaft to be extended and recessed so that a slotted metal plate can be mounted between the shaft head and the cylindrical housing.

2. Description of the Prior Art

The mounting of small outboard trolling motors on boats typically involves the mounting of a plate or bracket on an external surface; the motor itself can be attached to the plate or bracket by suitable hardware. After trolling operations are completed, the trolling motor must be removed from the water so that it will not be damaged during the higher speed operation made possible by the larger outboard engine used for general boat transport.

Two current methods of mounting and removing the trolling motor exist. First, a "bow mount" can be used, which consists of a bracket mounted on the deck of the boat at its forward tip. The bracket is fashioned so that it mates with a quick release coupling on the shaft or housing of the trolling motor itself. While this method allows removal of the motor, the mounting bracket remains permanently affixed to the deck. In the second method, a plate is attached to the side of the boat, or to the boat's railing. The motor is then attached to the plate. Again, the motor can be removed easily, but the mounting plate is still permanently attached, which is both unsightly and aerodynamically inefficient.

The present invention addresses the problems of the prior art by providing a quick release fastener which is embedded in the side of the boat or other parent object, which will quickly fasten or release the entire motor mounting plate itself, thereby restoring the smooth surface contour that existed prior to the addition of the mount or other external appendage.

BRIEF DESCRIPTION OF THE DRAWINGS

FIG. 1 is a perspective view of a boat to which is fastened a trolling motor by means of the present invention.

FIG. 2 is a perspective view of the present invention shown in FIG. 1 depicting an "expanded" view of the relationship of various components to each other and to the parent object.

DETAILED DESCRIPTION OF THE INVENTION

Figure 3:
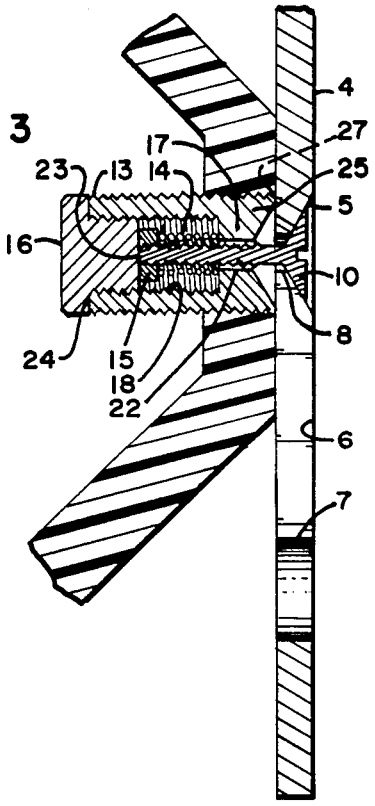
FIG. 3 is a side elevational view of the present invention shown in FIG. 1.
Figure 4:
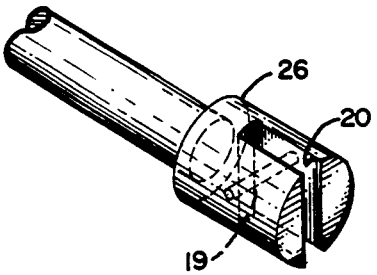
FIG. 4 is a perspective view of the head of the fastening system shaft as used in another embodiment of the present invention.
Figure 5:
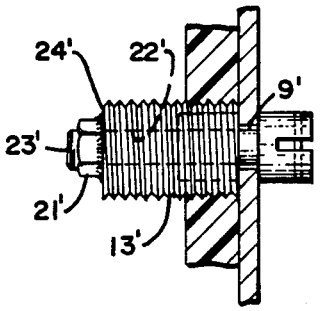
FIG. 5 is a side elevational view of the other embodiment of the present invention shown in FIG. 4.

Referring to the drawings, wherein like numerals represent like parts throughout the several views, there is generally designated at 4 a plate to which is mounted a trolling motor 3. The plate 4 is attached to a boat 1 or other parent object by means of a shaft 9 housed within a cylinder 13. The plate 4 contains two vertically aligned slots 6, which terminate at their lower ends in a large opening 7, and which terminate at their upper ends at a counter sunk orifice 8. The counter sunk orifice is surrounded by a bevelled surface 5. The shaft 9 passes through one of the slots 6 in plate 4, the tapered head 10 of shaft 9 being compatibly shaped so that it will mate with the bevelled surface 5 when the shaft 9 is fully inserted into counter sunk orifice 8.

The shaft 9, after passing through slot 6, extends to the cylinder 13, which is mounted within the side of boat 1. Specifically, the outer surface of cylinder 13 is threaded such that it can be mounted within the hull material of boat 1 by insertion into a compatibly threaded orifice 12. Threaded orifice 12 can be formed within the hull material of boat 1 by drilling a pilot hole of a diameter somewhat smaller than the outer diameter of cylinder 13, and then forcibly rotating cylinder 13 such that compatible threads are cut into the inner surfaces of the hull material of boat 1 which form and surround threaded orifice 12. Cylinder 13 has a first end 25 and a second end 24, the first end 25 being flush with the outer surface of the boat 1.

Within cylinder 13 is a longitudinal bore 22 having a diameter greater than the diameter of shaft 9 such that shaft 9 can slide freely within bore 22. The diameter of bore 22 further enlarges at approximatley the longitudinal midpoint of cylinder 13 to form a cavity 18 within cylinder 13. The transition in diameters between bore 22 and cavity 18 forms a bearing surface 17 within cylinder 13 at the approximate longitudinal midpoint of cylinder 13. Cavity 18 is sealed by a cap 16 which is inserted into the second end 25 of cylinder 13.

Shaft 9 extends within cylinder 13 by passing through bore 22 and into cavity 18. Attached to the end 23 of shaft 9 is a thrust block 15, which is of a diameter smaller than the diameter of cavity 18 but larger than the diameter of bore 22, thereby permitting shaft 9 to slide freely within cavity 18, but preventing shaft 9 from being completely withdrawn from cavity 18.

Shaft 9 is biased to remain with cylinder 13 by a spring 14. Spring 14 is confined within cavity 18 by bearing surface 17 and thrust block 15, such that the expansive force of spring 14 presses against thrust block 15, thereby urging shaft 9 to move deeper into cylinder 13 until the inward travel of shaft 9 is stopped by the collision of thrust block 15 with cap 16.

In another embodiment of the invention, bore 22' extends the entire length of cylinder 13'. The end 23' of shaft 9' is threaded to accept a nut 21 which is permanently affixed to end 24' of cylinder 13'. The shaft 9' is inserted into cylinder 13' and through nut 21, the insertion and removal of shaft 9' being accomplished by rotation of shaft 9'. In this embodiment, thrust block 15, spring 14 and cavity 18 are not needed.

In either embodiment of the invention, the head of shaft 9 can be formed in the shape of a rectangular cylinder 26, within which is cut a groove 20. A pin 19 is mounted transversely through groove 20 in order that a suitable tool can be inserted within groove 20 to grasp or hook pin 19 and thereby control the movement of shaft 9 into cylinder 13.

In operation, trolling motor 3 is mounted by conventional means to plate 4. Cylinder 13 is mounted inside threaded orifice 12, orifice 12 passing through the hull material of boat 1. A cylinder 13 is mounted within the hull material of boat 1 to correspond to each slot 6 in plate 4. The cylinder 13 can be mounted at any convenient location on boat 1, but will typically be mounted within a portion of the hull which defines a vertical surface. In a typical boat 1 used for trolling operations, the trim 2 of the boat 1 will be placed by its manufacturer on a vertical surface. In such a boat, the trolling motor mount would be installed by removing an amount of trim 2 corresponding to the width of plate 4. The trim support bracket 11 would be left in place.

A pilot hole would be drilled in the hull material of boat 1 at the point where threaded orifice 12 was desired. Threaded cylinder 13 is then forceably rotated by means of a screwdriver inserted across indentations 27 and groove 20, which may be cooperatively aligned by rotating shaft 9, thereby cutting threads into the pilot hole and creating threaded orifice 12 while simultaneously inserting cylinder 13 within it.

In order to mount plate 4 to the boat 1, the shaft 9 is pulled away from boat 1, for each cylinder 13 that has been installed in boat 1. Plate 4 is then lifted such that the large opening 7 is aligned with the shaft 9. The head 10 of shaft 9 is inserted through large opening 7 and plate 4 is lowered until head 10 reaches coutersunk orifice 8. Shaft 9 is then permitted to slide into cyliner 13 until head 10 is mated with bevelled surface 5 and plate 4 is securely pressed against the hull surface of boat 1.

In order to remove the plate 4, the shaft 9 is again partially withdrawn from the cylinder 13 and plate 4 is lifted until the head 10 reaches the large opening 7. The head 10 will then pass through large opening 7 as the plate is moved away from the boat. The shaft 9 is then reinserted into cylinder 13 until the head 10 is flushably mated with cylinder 13, thereby preserving the smooth exterior surface of the boat 1.

In this manner, the present invention eliminates the need to have a trolling motor mount which is permanently attached to the surface of the boat. Since the trolling motor must be removed frequently during a typical fishing excursion, and often will not be required at all when the boat is used for other purposes, the present invention permits a rapid method for performing the mounting and unmounting operation. Furthermore, when the trolling motor is not needed, there are no permanent mounting fixtures protruding from the boat.

I claim:

1. An apparatus for attaching a motor to a boat, comprising:

(a) a mounting plate perforated by at least two vertical slots;

(b) an external threaded cylinder having a first end and a second end, wherein the interior of the cylinder contains a longitudinal bore having a first diameter adjacent to the first end of the cylinder and having a second diameter adjacent to the second end of the cylinder, the first diameter being smaller than the second diameter such that the transition between the first diameter and the second diameter forms a bearing surface within the cylinder;

(c) a cap inserted into the second end of the cylinder such that a cavity is formed within the cylinder between the cap and the bearing surface;

(d) a shaft passing through each of the vertical slots of the mounting plate, the shaft being slidably mounted within the cylinder, the shaft having a first end formed as a head and having a second end formed as a thrust block, the thrust block residing within the cavity;

(e) a spring mounted within the cavity, such that the spring exerts an expansive force against the thrust block, thereby biasing the head of the shaft toward the cylinder.

2. An apparatus for attaching a motor to the side of a boat, comprising:

(a) a mounting plate perforated by at least two vertical slots, the slots in the plate having a width, the slots terminating at a first end and a second end, the first end of the slot being formed as a circular perforation, the second end of the slot being formed as a bevelled perforation;

(b) a bolt passing through each of the slots in the plate, each bolt having:

(i) a first end and a second end, the first end of said bolt terminating in a tapering head, the tapering head having a lateral dimension, the tapering head of the bolt containing a transverse groove, the groove containing a pin fastened generally perpendicularly across the groove; and (ii) a diameter, the diameter of the bolt being dimensionally larger than the width of the slots in the plate, the lateral dimension of the head of the bolt being dimensionally larger than the bevelled perforation at the second end of the slot, such that the head of the bolt flushably mates with the bevelled perforation in the plate; and (c) a cylinder mounted in an orifice within the side of a boat, wherein a threaded longitudinal bore accepts the bolt, the cylinder having a first end and a second end, the first end facing the head of the bolt, the first end of the cylinder being contoured such that the bolt head is flushably mated with the cylinder when the plate is removed.

3. An apparatus for mounting an object to a surface comprising:

(a) a plate, the plate being perforated by vertical slots having a first end and a second end, the first end being formed as a countersunk orifice dimensionally larger than the width of the slot, the second end being formed as a circular orifice dimensionally larger than the countersunk orifice;

(b) a threaded shaft, the shaft having a first end and a second end, the first end consisting of a grooved head, the grooved head of the shaft containing a pin, the pin passing generally perpendicularly through the grooved head, wherein the shaft is capable of passing through the slots in the plate;

(c) a threaded cylinder, mounted flush beneath the surface, the cylinder containing a longitudinal bore, wherein the longitudinal bore is compatibly threaded to mate with the threaded shaft.

* * * * *